US009314681B2

(12) United States Patent
Palardis

(10) Patent No.: US 9,314,681 B2
(45) Date of Patent: Apr. 19, 2016

(54) BATTING BALL ON A CABLE HAVING A LOW FRICTION SURFACE TO PROVIDE PROPER SWING TECHNIQUE AND MUSCLE MEMORY

(71) Applicant: Charles Steven Palardis, Tampa, FL (US)

(72) Inventor: Charles Steven Palardis, Tampa, FL (US)

( * ) Notice: Subject to any disclaimer, the term of this patent is extended or adjusted under 35 U.S.C. 154(b) by 0 days.

(21) Appl. No.: 14/622,649

(22) Filed: Feb. 13, 2015

(65) Prior Publication Data

US 2015/0157911 A1 Jun. 11, 2015

Related U.S. Application Data

(63) Continuation-in-part of application No. 13/770,116, filed on Feb. 19, 2013, now abandoned.

(60) Provisional application No. 61/605,623, filed on Mar. 1, 2012.

(51) Int. Cl.
*A63B 69/00* (2006.01)
*A63B 71/02* (2006.01)

(52) U.S. Cl.
CPC ..... *A63B 69/0002* (2013.01); *A63B 69/0084* (2013.01); *A63B 71/022* (2013.01); *A63B 2069/0008* (2013.01); *A63B 2210/50* (2013.01)

(58) Field of Classification Search
CPC ..... A63B 69/002; A63B 69/0084; A63B 69/0079; A63B 69/0075; A63B 69/0091; A63B 69/00; A63B 69/38; A63B 2069/0008; A63B 2069/0006; A63B 43/007
USPC ..... 473/422, 430, 423, 459, 453, 424, 428, 473/457, 458, 468, 426, 575, 429, 451
See application file for complete search history.

(56) References Cited

U.S. PATENT DOCUMENTS 667,563 A * 2/1901 Oakley ..... A63B 69/0088 473/424
1,446,641 A * 2/1923 Craig ..... A63B 43/007 473/147
1,826,221 A * 10/1931 Pearson ..... A63B 43/02 473/466
2,680,022 A * 6/1954 Walden ..... A63B 69/0084 473/428
3,042,401 A * 7/1962 Denegre ..... A63B 69/0084 473/430
3,086,775 A * 4/1963 Albert ..... A63B 69/0084 473/428
3,469,840 A * 9/1969 Kruzel ..... A63B 69/0084 473/428
3,558,134 A * 1/1971 Hoitsma ..... A63B 69/0075 473/428

(Continued)

*Primary Examiner* — Mitra Aryanpour
(74) *Attorney, Agent, or Firm* — Tiffany C. Miller; Inventions International Inc.

(57) ABSTRACT

A batting ball is slidably mounted on a line having a low friction surface to provide proper swing technique and muscle memory. The line has an impact absorbing member having an impact end configured to contact a ball and a receiving chamber configured to receive a resilient member adapted to connect with a portion of a washer. A bushing having a helical portion with a central opening is inserted and affixed into a ball opening. The ball opening has a recess configured to retain an end portion of the bushing. The central opening of the bushing will receive the line. The plurality of balls are mounted onto the line with a washer located at each end between the attaching elements and the balls. A swivel snap hook is connected to an end of the cable by a thimble and clamp set located opposite the hook and eye turn buckle.

5 Claims, 6 Drawing Sheets

(56) References Cited

U.S. PATENT DOCUMENTS 3,630,521 A * 12/1971 Lingbeek ..... A63B 69/0084 473/426
3,658,330 A * 4/1972 Maestracci ..... A63B 69/0084 473/429
3,703,286 A * 11/1972 Adkin ..... A63B 69/0084 473/428
3,754,761 A * 8/1973 Pruss ..... A63B 69/0084 473/428
3,924,855 A * 12/1975 Pretorius ..... A63B 69/0084 473/430
3,953,028 A * 4/1976 Gowins ..... A63B 69/0084 473/428
4,027,880 A * 6/1977 Hadtke ..... A63B 69/0084 473/426
4,521,016 A * 6/1985 Tominaga ..... A63B 69/0084 473/430
4,674,744 A * 6/1987 Walsh ..... A63B 69/0084 473/430
4,735,413 A * 4/1988 Yamanouchi ..... A63B 69/0084 473/426
4,944,513 A * 7/1990 Zentner ..... A63B 69/0084 473/428
5,413,347 A * 5/1995 Prater ..... A63B 69/0084 473/147
5,452,888 A * 9/1995 Glenn ..... A63B 43/007 473/424
5,611,539 A * 3/1997 Watterson ..... A63B 69/0084 473/428
6,033,323 A * 3/2000 McCown ..... A63B 69/0088 473/423
6,042,491 A * 3/2000 Dixon, Jr. ..... A63B 69/0002 473/423
6,435,989 B1 * 8/2002 Grubman ..... A63B 69/0002 473/422
7,033,290 B1 * 4/2006 Coldren ..... A63B 69/0002 473/422
8,771,106 B1 * 7/2014 Boulanger ..... A63B 43/007 473/422
2003/0069093 A1 * 4/2003 Wojtkiewicz ..... A63B 69/0084 473/428
2004/0033848 A1 * 2/2004 Bragg ..... A63B 69/0002 473/423
2010/0130312 A1 * 5/2010 Fuentes ..... A63B 69/0079 473/429
2012/0238382 A1 * 9/2012 Allison ..... A63B 69/0084 473/428
2013/0116068 A1 * 5/2013 Traynor ..... A63B 69/0084 473/428
2014/0235373 A1 * 8/2014 Palardis ..... A63B 69/0084 473/428

* cited by examiner

BATTING BALL ON A CABLE HAVING A LOW FRICTION SURFACE TO PROVIDE PROPER SWING TECHNIQUE AND MUSCLE MEMORY

CROSS REFERENCE TO RELATED APPLICATIONS

This application is a continuation-in-part application entitled, "Batting Ball On A Cable Having A Low Friction Surface To Provide Proper Swing Technique and Muscle Memory," which claims priority to co-pending U.S. Non-Provisional patent application Ser. No. 13/770,116 filed Feb. 19, 2013, entitled, "Batting Ball On A Cable Having A Low Friction Surface To Provide Proper Swing Technique and Muscle Memory," which claims priority to U.S. Provisional Patent Application No. 61/605/623 filed Mar. 1, 2012, entitled, "Baseballs or softballs on a steel cable to provide proper swing technic and muscle memory."

BACKGROUND OF THE INVENTION

1. Field of the Invention

This invention relates, generally, to a baseball practice device. More particularly, it relates to a batting system having a ball and an impact absorbing member slidably mounted on a line.

2. Background Art

Conventional batting practices require more time, people, and equipment such as batting tees, balls, and a collection net to hit the same amount of balls. Current batting practices do not enforce proper muscle memory and hand-eye coordination.

More particularly, current batting systems require complex set-up on a field. Additionally, they do not allow for continual batting of balls with little delay in between each swing. Often a batter is dependent on other individuals to pitch the ball, to set the balls on a batting tee, to collect the balls, and to retrieve the balls.

Thus, there is a need for a batting system that allows for easy set-up at any field, is compact and easy to transport, promotes continual batting of balls with little delay in between each swing, and allows for a batter to practice independently without requiring anyone to pitch the balls, to set balls on batting tees, to retrieve the balls, and to collect the balls.

SUMMARY OF THE INVENTION

The long-standing but heretofore unfulfilled need for a batting system that is adapted for a ball and an impact absorbing member to be slidably mounted on a line which also includes improvements that overcome the limitations of prior art baseball practice devices is now met by a new, useful, and non-obvious invention.

The novel batting device includes a cable having a low friction surface including, but not limited to, nylon, rubber, vinyl, or plastic. A hook and eye turnbuckle is connected to an end of the cable by a fastener including, but not limited to, a thimble and clamp set. A swivel snap hook is connected to an end of the cable located opposite the hook and eye turn buckle. The swivel snap hook is connected to the end of the cable by a fastener including, but not limited to, a thimble and clamp set. At least one ball is slidably mounted to the cable. The ball includes, but is not limited to, a baseball, a softball, or a whiffle ball. More particularly, the preferred configuration is a plurality of balls slidably mounted on the cable.

This novel invention also includes an improved bushing with a central opening that is inserted and affixed into the hole that has been drilled into the center of the balls. The bushing includes, but is not limited to, metal or plastic. More particularly, the preferred bushing has a threaded portion connected to an outer wall of the bushing. The threaded portion is screwed into a hole through the center of the ball and can be adhered. This improved bushing is fixedly attached to the ball. The central opening of the bushing will receive the cable, allowing the bushing to slidably traverse the cable. It is within the scope of this invention for the ball to have at least one recess, whereby, the recess has an opening to receive the bushing. An end portion of the bushing is received by the recess and results with the bushing being flush with the outer surface of the ball. It is within the scope of this invention for the end portion of the bushing to not protrude from the outer surface of the ball.

Fender washers are slidably mounted onto the cable located towards each of the fasteners, including but not limited to, a thimble and clamp set. It is also within the scope of this invention to use any type of plate with a hole located thereon. The balls are mounted onto the cable with a washer located at each end between the hook and eye turnbuckle and the balls as well as between the swivel snap hook and the balls. The cable has the hook and eye turnbuckle and swivel snap hook connected to either end by the thimble and clamp set. The washers act as a barrier to prevent the balls from being penetrated by the thimble and clamp set upon impact.

The improved batting system is adapted for a batter to continuously swing at a ball independently while executing a proper swinging technique. An attaching element including, but not limited to, a swivel snap hook or a hook and eye turnbuckle are attached at the corner of a stationary object including, but not limited to, a chain link fence or a wooden fence, to form a triangle. At least one ball with an opening engages the improved bushing having a central opening that is fixedly attached to the opening of at least one ball. The central opening of the bushing receives the cable, thereby suspending the balls on the cable located between the washers and the fasteners. This improved bushing allows the balls to move with a low coefficient of friction along the cable. The cable is tightened with the use of the hook and eye turnbuckle until the cable is taut.

A further improvement of the batting system includes an impact absorbing member and resilient member located on the line between at least one ball and a fender washer. The impact absorbing member can be made of material including, but not limited to, rubber or foam. When a ball contacts the impact absorbing member, an end portion of the impact absorbing member conforms to a portion of the outer surface of the ball. A resilient member including, but not limited to, a spring is connected to an end of the impact absorbing member located opposite the ball contacting end. The spring is configured to absorb the kinetic energy from the traveling ball. An end of the spring will contact the fender washer upon impact.

A batting system has a line having a primary distal end located opposite a secondary distal end. The primary distal end has a primary attaching element. The secondary distal end has a secondary attaching element. The primary attaching element is connected to a primary stationary object. The secondary attaching element is connected to a secondary stationary object. A ball has an opening located through a central axis of the ball. The ball has a recess located on a perimeter of the opening of the ball. The recess is configured to retain an end portion of a support structure. The support structure has a length great enough to substantially span the width of the ball.

The support structure has a helical portion connected to an outer wall of the support structure. The helical portion rotatably engages the opening of the ball fixedly attaching the support structure to the ball. The support structure has a central opening receiving the line. The line penetrates the central opening allowing the support structure to slidably traverse the line.

A primary plate has an aperture to receive the line. The primary plate is located between the ball and the primary distal end of the line. A secondary plate has an aperture to receive the line. The secondary plate is located between the ball and the secondary distal end of the line.

A plurality of balls are slidably mounted on the line. The batting device has a tensioning device connected between the primary or secondary object and a portion of the line.

The line is configured to receive an impact absorbing member having an opening located through a central axis of the impact absorbing member. The impact absorbing member has an impact end located opposite a receiving chamber. The impact end is configured to conform to a portion of a ball. The impact end has an impact end opening configured to receive the line. The line penetrates the impact end opening allowing the impact absorbing member to slidably traverse the line.

The receiving chamber has a receiving end located opposite a capturing end. The receiving end has a receiving end opening configured to receive a resilient member. The resilient member has a primary end located opposite a secondary end. The secondary end of the resilient member is configured to connect with the capturing end, thereby, retaining a portion of the resilient member within the receiving chamber. The primary end of the resilient member is configured to protrude from the receiving end opening.

The capturing end has a capturing end opening having a smaller perimeter than the receiving end opening. The capturing end opening is configured to receive the line. The resilient member has a resilient member opening. The resilient member opening is located through a central axis of the resilient member. The line penetrates the resilient member opening allowing the resilient member to slidably traverse the line.

All the balls are pushed to one end of the cable towards the hook and eye turnbuckle or the swivel snap hook dependent on whether the batter is left handed or right handed. A ball can be separated by a user from the group of balls so the hitter can swing and hit the ball with a bat. The ball slides along the cable to the opposing end of the fence where the cable is fastened. This process is repeated until all the balls have been hit and have slidably traversed the cable. To begin the process at the beginning again, the balls are pulled back to where the hitter originally started. Alternatively, the balls are hit by a bat to the opposing end of the cable. The cable forces the hitter to develop proper swing technique and muscle memory. The cable does not allow the batter to swing under the ball, but forces a hitter to hit through the ball by making contact with the top of the ball.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
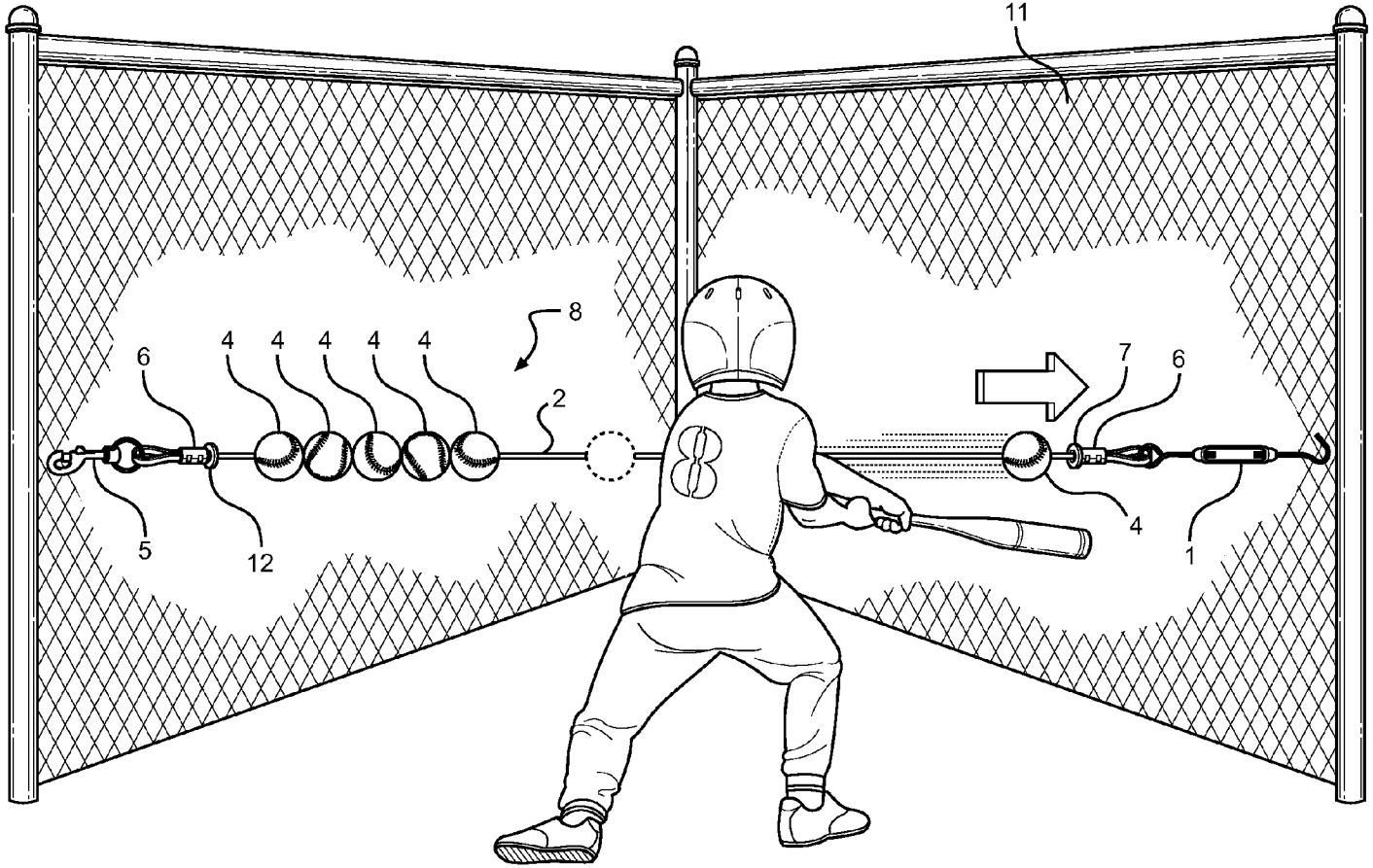
FIG. 1 is a perspective view of the batting system.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Each embodiment of the illustrative embodiments will accommodate novel bushing 3, regardless of the type of ball 4 that is slidably mounted on cable 2. Novel bushing 3 has a length great enough to substantially span the width of ball 4. Bushing 3 has a threaded portion connected to the outer wall of bushing 3. The threaded portion rotatably engages opening 9 fixedly attaching bushing 3 to ball 4. In an alternate embodiment, outer wall of bushing 3 can be adhered to opening 9 securing bushing 3 to ball 4. Bushing 3 has central opening 10 receiving cable 2, whereby cable 2 penetrates central opening 10 allowing bushing 3 to slidably traverse cable 2.

Figure 2:
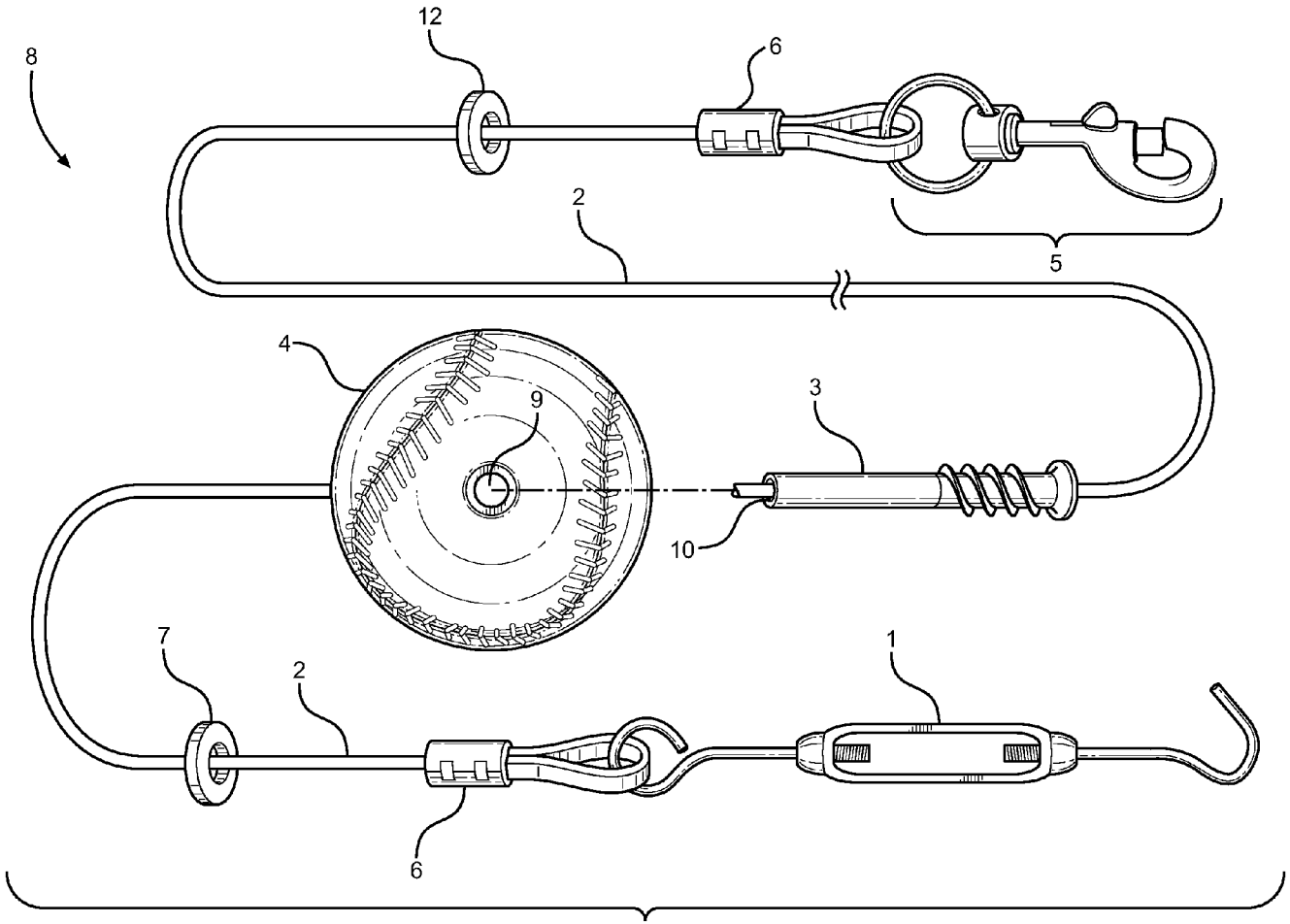
FIG. 2 is an exploded view of the batting system.

For instance, FIG. 2 shows batting system 8 with ball 4 being a baseball. The ball includes, but is not limited to a baseball, a softball, or a whiffle ball.

These embodiments are illustrative of the invention and are not exhaustive thereof. As batting system manufacturers add additional or different stationary objects, still further attaching elements may be required in future embodiments of the invention but all such future embodiments are within the scope of this invention.

For example, in a preferred embodiment as illustrated in FIG. 1, batting system 8 may be attached to an L-shaped chain link fence 11. Thus, the attaching elements including, but not limited to, hook and eye turnbuckle 1 and swivel snap hook 5 would connect both ends of cable 2 to chain link fence 11 to form a triangle. Alternatively, batting system 8 may be attached between two poles (not shown). Hook and eye turnbuckle 1 and swivel snap hook 5 connect both ends of cable 2 between two poles (not shown) to suspended cable 2.

Thus, attaching elements 1 and 5 will connect with all currently known stationary objects and in view of this disclosure any future changes in attaching elements 1 and 5 can be met.

In addition to the aforesaid embodiments of batting system 8, ball 4 includes multiple additional improvements as well.

A first improvement as shown in FIG. 2 is of ball 4 having opening 9. Opening 9 receives bushing 3 having a helical portion 13 connected to an outer wall of bushing 3. The helical portion 13 rotatably engages opening 9 fixedly attaching bushing 3 to ball 4. Alternatively, an adhesive can be used to secure bushing 3 to ball 4. Bushing 3 has a central opening 10 which receives cable 2. Cable 2 penetrates central opening 10 allowing bushing 3 to slide across cable 2 with ease.

A second improvement of batting device 8 includes washer 7 having an aperture receiving cable 2. Washer 7 is located between ball 4 and hook and eye turnbuckle 1. Additionally, batting device 8 includes washer 12 having an aperture receiving cable 2. Washer 12 is located between ball 4 and swivel snap hook 5. Washers 7 and 12 are configured to separate ball 4 from coming into contact with fastener 6 which secures attaching elements 1 and 5 to cable 2. This separation prevents damage to ball 4, to fasteners 6, and to batting system 8 as a whole upon impact.

Additional objects include, but are not limited to, the provision of batting system 8 having cable 2 suspending a plurality of balls 4, ball 4 having an improved bushing 3 with a helical portion to attach bushing 3 to ball 4, washers 7 and 12 separating ball 4 from attaching elements 1 and 5, and attaching elements 1 and 5 configured to be connected to stationary object 11.

In another embodiment, batting system 8 can have impact absorbing member 14. Impact absorbing member 14 has impact end 15 located opposite receiving chamber 16. In a preferred embodiment, impact absorbing member 14 is located on cable 2 between at least one ball 4 and at least one washer 7 and 12. Cable 2 is inserted through a central boar 17 of impact absorbing member. When resilient member 19 is inserted into receiving end opening 24 of receiving chamber 16, cable 2 is inserted through resilient member 19 then, through capturing end opening 18, and finally through impact opening 17.

Impact end 15 has a perimeter greater in size than the perimeter of receiving chamber 16. This greater size allows impact end 15 to conform to a portion of ball 4. Impact end 15 is configured to receive an outer surface of ball 4 resulting in the absorption of kinetic energy from the impact of ball 4. Impact end 15 of impact absorbing member 14 has opening 17 traversing through the length of impact absorbing member 14. Impact end opening 17 is configured to receive cable 2, allowing impact absorbing member 14 to be connected to cable 2. It is a preferred embodiment for ball 4 to contact impact absorbing member 14 to prevent damage to batting system 8 components including, but not limited to, ball 4, washers 7 and 12, and to fastener 6.

Receiving chamber 16 has receiving end 22 located opposite capturing end 23. Receiving end 22 has receiving end opening 24 configured to receive resilient member 19. Resilient member 19 includes, but is not limited to, a spring. Resilient member 19 has resilient member primary end 20 located opposite of resilient member secondary end 21. Resilient member 19 secondary end 21 is configured to be received by receiving end opening 24 of receiving chamber 16. A portion of resilient member 19 primary end 20 is configured to protrude from receiving chamber 16 receiving end opening 24. The protruding portion of resilient member 19 primary end 20 is configured to contact at least one washer 7 and 12 and to provide additional absorption of kinetic energy from the impact of ball 4 impacting impact end 15 of impact absorbing member 14.

In another embodiment, ball 4 can have recess 25. Recess 25 is configured to have opening 9 receiving bushing 3. An end portion of bushing 3 is configured to be flush with the outer surface of ball 4. In a preferred embodiment, bushing 3 does not protrude from the outer surface of ball 4. For example, when a primary ball comes into contact with an object including, but not limited to, a secondary ball, an end portion of bushing 3 of a second ball, a baseball bat, a washer, or an impact absorbing member, an end portion of bushing 3 of a primary ball will not become damaged. This is because the end portion of bushing 3 will not contact the object. The end portion of bushing 3 of a primary ball is flush with the outer surface of the primary ball.

Capturing end 23 of receiving chamber 16 has capturing end opening 18. Capturing end 23 has at least one wall that retains resilient member 19 secondary end 21 within receiving chamber 16. Capturing end 23 also blocks resilient member 19 from traversing the length of impact absorbing member 14 within the opening 17. When ball 4 comes into contact with impact end 15 of impact absorbing member 14, resilient member secondary end 21 comes into contact with capturing end 23 while primary end 20 of resilient member 19 comes into contact with washer 7.

These and other important objects, advantages, and features of the invention will become clear as this description proceeds.

The invention accordingly comprises the features of construction, combination of elements, and arrangement of parts that will be exemplified in the description set fourth hereinafter and the scope of the invention will be indicated in the claims.

Construction of the Novel Batting System

Figure 3:
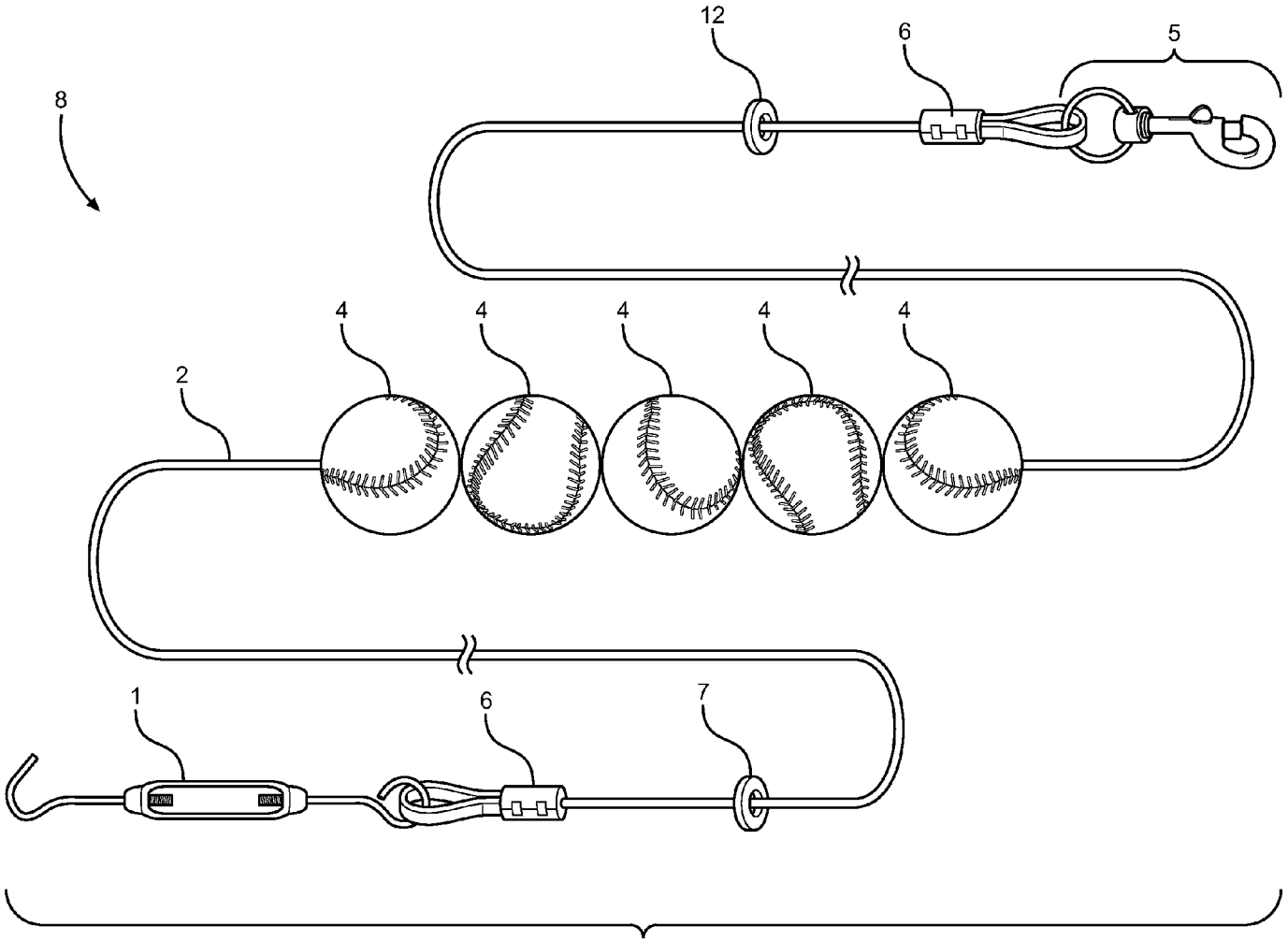
FIG. 3 is a side view of the batting system.

Referring now to FIGS. 1-3 show batting system 8 having cable 2 suspended from stationary object 11. Cable 2 has an end connected to hook and eye turnbuckle 1 and an opposite end connected to swivel snap hook 5. Hook and eye turnbuckle 1 and swivel snap hook 5 are connected to cable 2 with a fastener including, but not limited to, a thimble and clamp set 6. Hook and eye turnbuckle 1 is attached to stationary object 11. Swivel snap hook 5 is attached to stationary object 11. Primary washer 7 receives cable 2 and is located between ball 4 and hook and eye turnbuckle 1. Secondary washer 12 is located between ball 4 and swivel snap hook 5.

Figure 4:
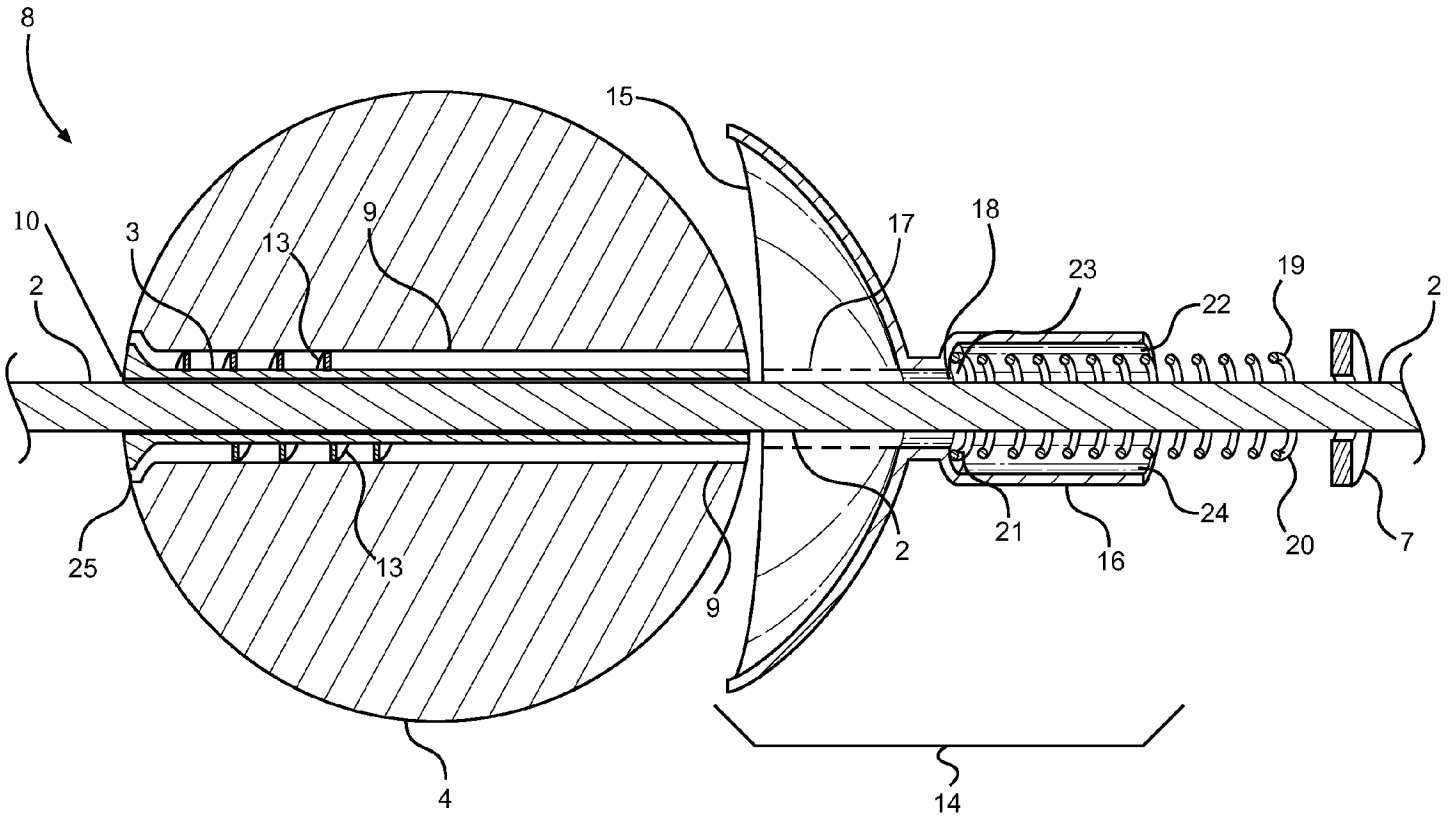
FIG. 4 is a side cut away view of the impact absorbing member, resilient member, and the ball having a recess.

FIG. 2 shows batting system 8 having ball 4 with opening 9 located through a central axis of ball 4. Bushing 3 spans the width of ball 4 and has opening 10 receiving cable 2. Bushing 3 has helical portion 13 connected to an outer wall of bushing 3. FIG. 4 depicts opening 9 having recess 25 configured to receive an end portion of bushing 3.

Figure 5:
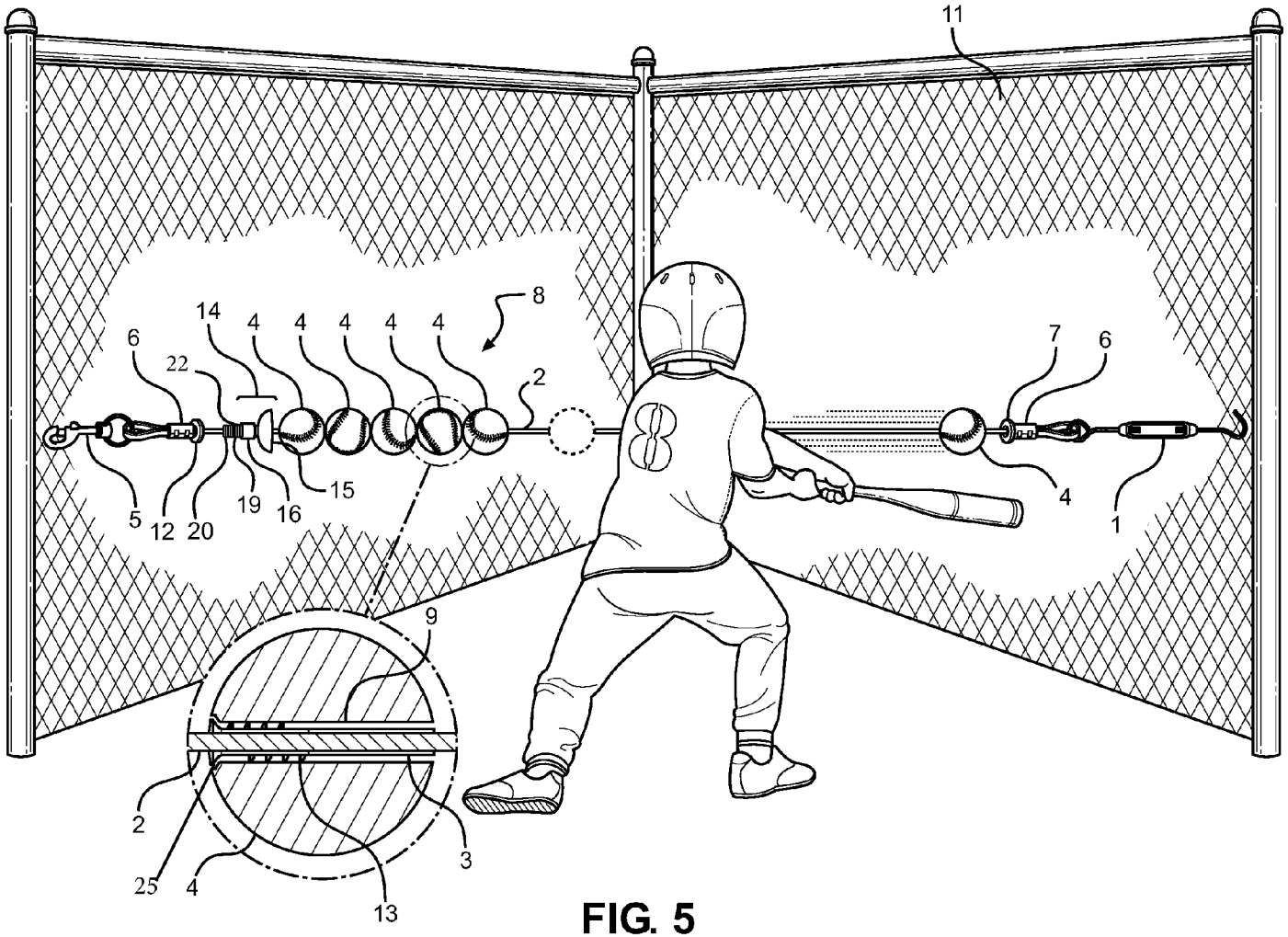
FIG. 5 is a perspective view of the batting system having an impact absorbing member and resilient member along the cable; and, FIG. 6 is an exploded view of the impact absorbing member and resilient member along the cable.
Figure 6:
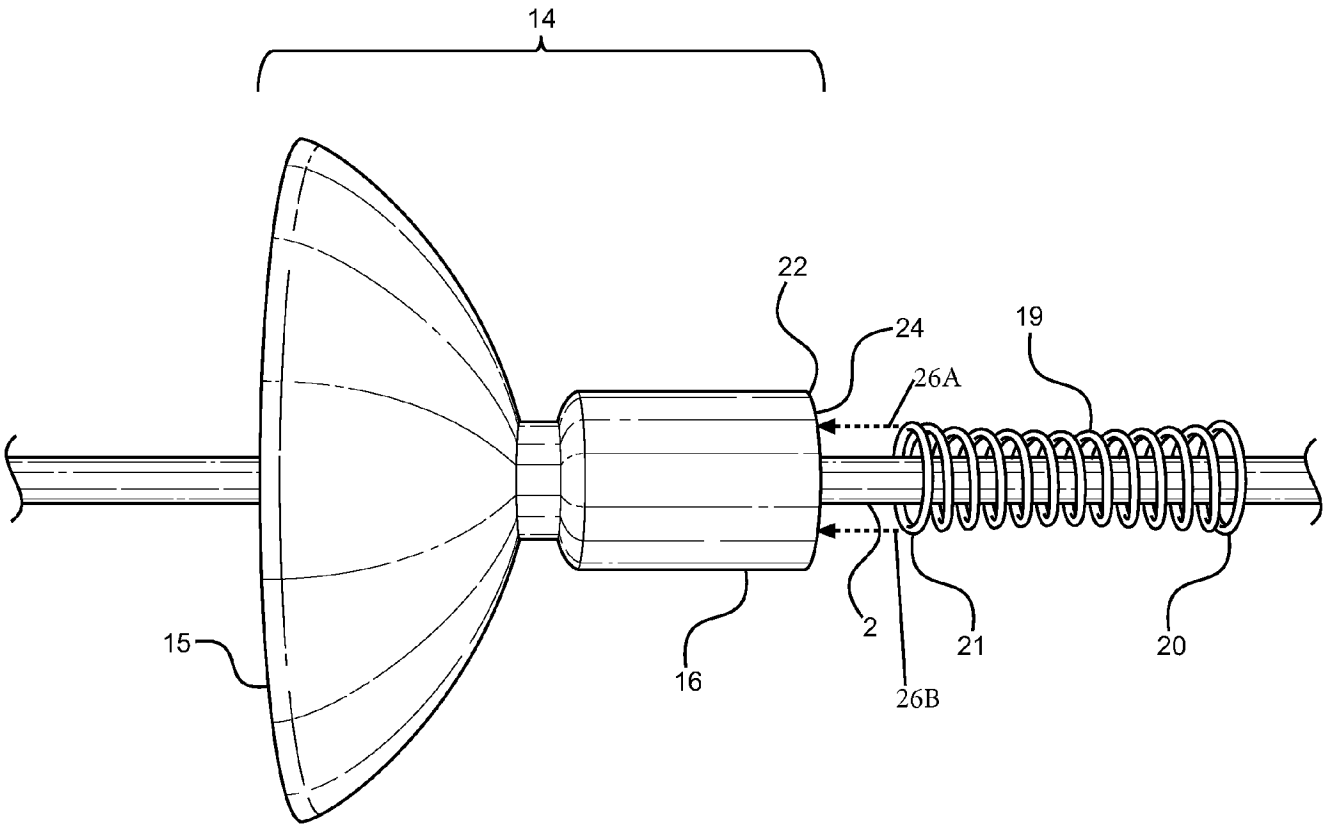

FIGS. 4-6 illustrate impact absorbing member 14 having impact end 15 configured to contact ball 4 and a receiving chamber 16 configured to receive resilient member 19. FIG. 4 best shows receiving chamber having capturing end 23 having opening 18 located opposite receiving end 22 having opening 24. Capturing end 23 opening 18 is smaller in size than receiving end opening 24. The smaller size of capturing end 23 opening 18 is great enough in size to allow the cable 2 to enter opening 18. Resilient member 19 cannot fit through capturing end opening 18. However, resilient member 19 is received by (26A and 26B) receiving end opening 24 and retained within receiving chamber 16 by capturing end 23. Secondary end 21 of resilient member is configured to contact capturing end 23 of receiving chamber 16. Capturing end 23 prevents resilient member 19 from traversing through opening 18 and along opening 17. Resilient member primary end 20 is configured to protrude from opening 24 of receiving chamber and is configured to contact washer 7.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A batting system, comprising:

a line having a first distal end located opposite of a second distal end;

said first distal end having a first attaching element;

said second distal end having a second attaching element;

said first attaching element connected to a first stationary object;

said second attaching element connected to a second stationary object;

a ball having an opening, said opening located through a central axis of said ball, said ball having a recess located on a perimeter of said opening of said ball, whereby, said recess is configured to retain an end portion of a support structure;

said support structure having a length great enough to substantially span the width of said ball;

said support structure having a helical portion connected to an outer wall of said support structure, whereby said helical portion rotatably engages said opening of said ball fixedly attaching said support structure to said ball, said support structure having a central opening, said central opening receiving said line, whereby said line penetrates said central opening allowing said support structure to slidably traverse said line;

a first plate having an aperture to receive said line, said first plate located between said ball and said first distal end of said line;

a second plate having an aperture to receive said line, said second plate located between said ball and said second distal end of said line;

said line configured to receive an impact absorbing member having an opening, said opening is located through a central axis of said impact absorbing member, said impact absorbing member having an impact end located opposite a receiving chamber;

said impact end configured to connect to a portion of said ball, said impact end having an impact end opening configured to receive said line, whereby, said line is configured to penetrate said impact end opening allowing said impact absorbing member to slidably traverse said line;

said receiving chamber having a receiving end located opposite a capturing end;

said receiving end having a receiving end opening configured to receive a resilient member, said resilient member having a first end located opposite a second end, whereby, said second end of said resilient member is configured to connect with said capturing end, thereby, retaining a portion of said resilient member within said receiving chamber, said first end of said resilient member is configured to protrude from said receiving end opening;

said capturing end having a capturing end opening, said capturing end opening having a smaller perimeter than said receiving end opening, whereby, said capturing end opening is configured to receive said line; and, said resilient member having a resilient member opening, said resilient member opening is located through a central axis of said resilient member, whereby, said line penetrates said resilient member opening allowing said resilient member to slidably traverse said line.

2. The batting device of claim 1, having a tensioning device connected between said first or second stationary object and a portion of said line.

3. A batting system, comprising:

a line having a first distal end located opposite of a second distal end;

said first distal end having a first attaching element;

said second distal end having a second attaching element;

said first attaching element connected to a first stationary object;

said second attaching element connected to a second stationary object;

a ball having an opening, said opening located through a central axis of said ball;

a support structure having a length great enough to substantially span the width of said ball;

said support structure having a helical portion connected to an outer wall of said support structure, whereby said helical portion rotatably engages said opening fixedly attaching said support structure to said ball, said support structure having a central opening, said central opening receiving said line, whereby said line penetrates said central opening allowing said support structure to slidably traverse said line;

said line configured to receive an impact absorbing member having an opening, said opening is located through a central axis of said impact absorbing member, said impact absorbing member having an impact end located opposite a receiving chamber;

said impact end configured to conform to a portion of said ball, said impact end having an impact end opening configured to receive said line, whereby, said line is configured to penetrate said impact end opening allowing said impact absorbing member to slidably traverse said line;

said receiving chamber having a receiving end located opposite a capturing end;

said receiving end having a receiving end opening configured to receive a resilient member, said resilient member having a first end located opposite a second end, whereby, said second end of said resilient member is configured to connect with said capturing end, thereby, retaining a portion of said resilient member within said receiving chamber, said first end of said resilient member is configured to protrude from said receiving end opening;

said capturing end having a capturing end opening, said capturing end opening having a smaller perimeter than said receiving end opening, whereby, said capturing end opening is configured to receive said line;

said resilient member having a resilient member opening, said resilient member opening is located through a central axis of said resilient member, whereby, said line penetrates said resilient member opening allowing said resilient member to slidably traverse said line;

a first plate having an aperture to receive said line, said first plate located between said ball and said first distal end of said line; and, a second plate having an aperture to receive said line, said second plate located between said ball and said second distal end of said line.

4. The batting device of claim 3, having a tensioning device connected between said first or second stationary object and a portion of said line.

5. The batting device of claim 3, wherein said ball having a recess located on a perimeter of said opening of said ball, whereby, said recess is configured to retain an end portion of a support structure.

* * * * *